United States Patent [19]

Davis et al.

[11] Patent Number: 4,457,575

[45] Date of Patent: Jul. 3, 1984

[54] ELECTRICAL CONNECTOR HAVING IMPROVED SHIELDING AND KEYING SYSTEMS

[75] Inventors: Wayne S. Davis, Harrisburg; Robert C. Swengel, Jr., York, both of Pa.

[73] Assignee: AMP Incorporated, Harrisburg, Pa.

[21] Appl. No.: 420,762

[22] Filed: Sep. 21, 1982

[51] Int. Cl.[3] ..... H01R 13/648

[52] U.S. Cl. ..... 339/143 R; 339/176 MP; 339/186 M

[58] Field of Search ..... 339/14 R, 143 R, 176 MP, 339/184, 186, , 184 RM, 186 RM

[56] References Cited

U.S. PATENT DOCUMENTS 3,287,031 11/1966 Simmons et al. ..... 285/27
3,873,172 3/1975 Paullus ..... 339/17 F
4,269,467 5/1981 Hughes ..... 339/176 M X
4,337,989 7/1982 Asick et al. ..... 339/143 R

*Primary Examiner*—Eugene F. Desmond
*Attorney, Agent, or Firm*—F. W. Raring

[57] ABSTRACT

A shielded and keyed electrical connector assembly comprises a shielded plug and a shielded receptacle. Forward portions of the plug are received in the plug-receiving opening of the receptacle. The shielding on the receptacle has integral shield contact members which extend into the opening and which engage the shielding on the plug when the parts are mated. Keying is achieved by at least one key in the plug-receiving opening and a keyway in the forward portion of the plug. The key and the shielding contacts are located such that they do not interfere with each others' functions.

6 Claims, 7 Drawing Figures

ELECTRICAL CONNECTOR HAVING IMPROVED SHIELDING AND KEYING SYSTEMS

FIELD OF THE INVENTION

This invention relates to connector receptacles and connector assemblies of the type comprising a plug and a receptacle. The invention is particularly directed to improved keying and shielding systems for receptacles and connector assemblies.

BACKGROUND OF THE INVENTION

U.S. Pat. Nos. 4,193,654, 4,210,376 and 4,221,458 show a known type of electrical connector assembly comprising a plug and a receptacle which is coming into widespread use in the communications industry and on computer and computer related equipment. The receptacles shown in the above identified U.S. Patents are dimensioned to receive connector plugs of the general type shown in U.S. Pat. No. 3,860,316.

When connector assemblies of the type identified above are used in telephone equipment, it has ordinarily not been necessary in the past to provide either shielding for the connector parts or keying of individual plugs to individual receptacles. The requirement for shielding, however, is becoming widespread and many future plugs and receptacles will require such shielding.

It is also desirable to provide a keying system for connector plugs and receptacles as described in the above identified U.S. Patents, particularly where the connectors are used in computer-type equipment. Connector assemblies of the type described above will, in the future, be manufactured with greater numbers of terminals than are required in ordinary telephone equipment and several connector assemblies might be used in close proximity to each other so that mis-mating of connector plugs and receptacles can result with the potential for serious damage to the equipment.

The provision of a keying system in combination with a shielding system on connector assemblies of the type under consideration presents problems which are not ordinarily encountered when it is desired to provide either shielding or a keying system on the parts of a connector assembly. An effective shielding system requires that when the plug of the assembly is inserted into the receptacle, the shielding material on the plug must be placed in contact with the shielding material on the receptacle and the provision of suitable contact means which satisfies this requirement interferes with the function of most types of keying systems for connector assemblies. The present invention is thus directed to that achievement of a connector assembly having both an effective shielding system and a keying system which does not interfere with the effectiveness of the shielding system.

A preferred embodiment of the invention comprises an electrical connector receptacle of the type comprising a molded insulating housing having a mating end, a rearward end, oppositely facing first and second housing sidewalls and oppositely facing housing endwalls extending from the mating end to the rearward end. A plug-receiving opening extends into the mating end, the opening having opposed first and second opening sidewalls which are proximate to the first and second housing sidewalls, and opposed opening endwalls. A plurality of receptacle terminals are contained in the receptacle, the terminals being arranged in a row which extends between the opening endwalls. Each terminal has a cantilever spring contact portion which extends from the second opening sidewall at a location proximate to the mating end diagonally into the opening towards the inner end of the opening. The opening is dimensioned to receive a plug having plug terminals therein which contact the cantilever spring contact portions. The receptacle is characterized in that it has at least one key on the first opening sidewall, the key having a leading end and an inner end, the leading end being proximate to, and spaced from, the mating end of the housing and the inner end being remote from the mating end of the housing. A receptacle shield is provided on the housing, the receptacle shield extending over the mating end and to the plug-receiving opening and having shield contact extensions extending into the plug-receiving opening for contacting the plug shield on a complementary plug upon insertion of the plug into the opening. The shield contact extensions are adjacent to the first opening sidewall.

In accordance with a further embodiment, the receptacle shield is of stamped and formed sheet metal and the shield contact extensions are cantilever springs which are integral with the shield and which extend diagonally into the plug-receiving opening.

In accordance with a further embodiment, a connector assembly comprises a plug and a receptacle, the receptacle being as described above and the plug having a plug shield. The plug shield overlaps the forward portions of the plug which are received in the plug-receiving opening of the receptacle and the plug shield extends to the rearward end of the plug. The keyway which receives the key in the receptacle is provided in the plug housing in the forward portions thereof.

DESCRIPTION OF THE DRAWINGS

As shown in FIGS. 1–4, a connector assembly in accordance with the invention comprises a plug 2 and a receptacle 4. In the disclosed embodiment, the connector assembly serves to connect the conductors 6 in a jacketed and shielded cable 8 to the conductors 10 on the lower surface 12 of a circuit board 14 having an upper surface 16. The circuit board extends normally of a panel 18 and the connector receptacle is mounted in an opening in the panel and on the circuit board as shown in FIG. 4.

Figures 1, 2:
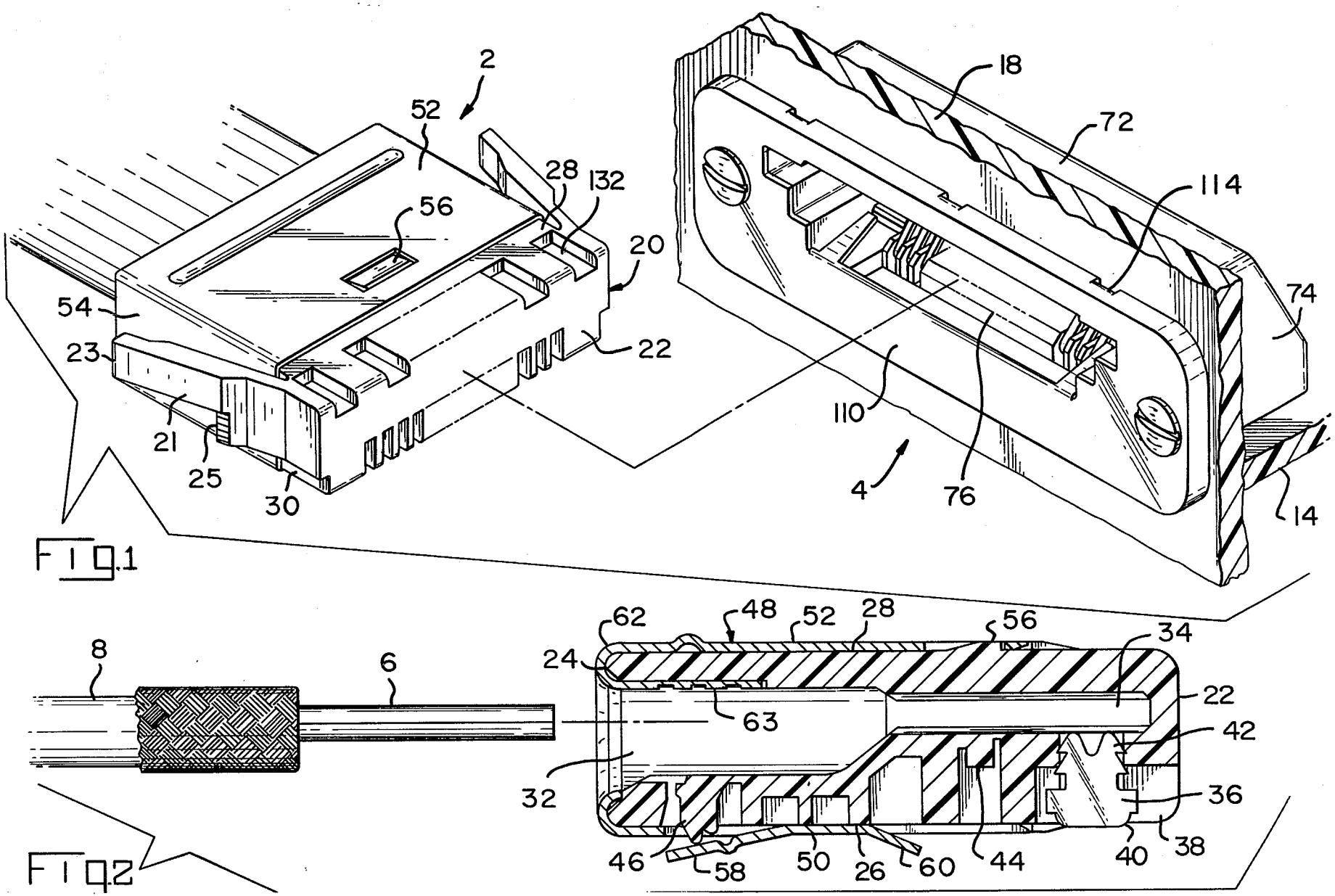
FIG. 1 is a perspective view of a plug and receptacle in accordance with the invention offset from each other showing the mating ends of the plug and receptacle.
FIG. 2 is a sectional side view of the plug showing a cable in alignment with the cable-receiving opening of the plug.

The plug 2 is of the general type shown in U.S. Pat. No. 3,860,316 and comprises a molded housing 20 having a mating end 22, a rearward end 24, and upper or first housing sidewall 28, a second or lower housing sidewall 26, and oppositely facing housing endwalls 30. Latch arms 21 are molded integrally with the endwalls 30 and extend divergently therefrom to their free ends 23. The latch arms have shoulders 25 intermediate therein for cooperation with shoulders 88 in the receptacle to latch the parts to each other.

Figure 3:
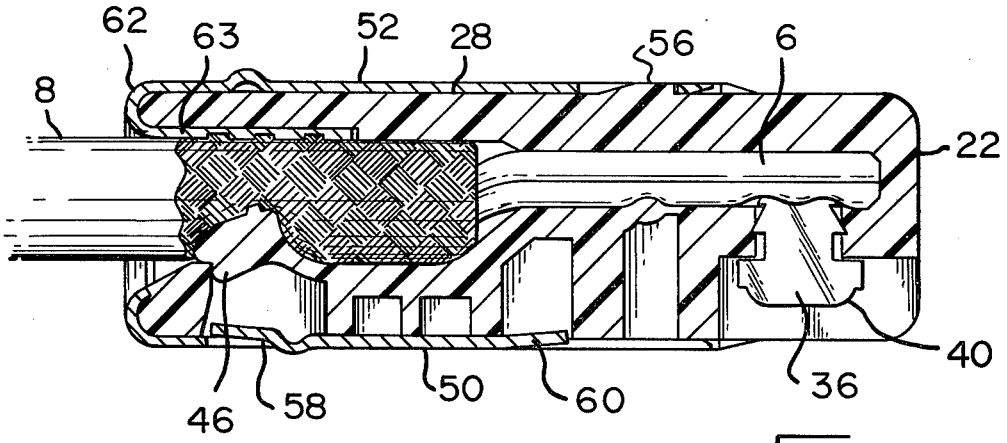
FIG. 3 is a view similar to FIG. 2 but showing the plug installed on the end of the cable.

A cable-receiving opening 32 extends into the rearward end 24 of the plug housing and has a reduced cross-sectional area portion 34 which receives the individual conductors of the cable. The plug terminals 36 are contained in recesses 38 which extend inwardly from the lower housing sidewall 26 and from the mating end 22. The terminals have contact surface portions 40 on the lower edges as viewed in FIG. 3 and have insulation piercing barbs 42 which penetrate the insulation of the conductors 6 when the terminals are driven inwardly of the housing from the position of FIG. 2 to the position of FIG. 3.

As described in the above U.S. Pat. No. 3,860,316, a portion 44 of the housing is indented onto the individual conductors to provide a clamp or strain relief for the conductors. A cable clamp or strain relief is also provided as shown at 46 proximate to the rearward end of the housing as described in the above identified U.S. Patent. Additional openings are provided in the lower sidewall of the housing in conformity with good molding practice.

A sheet metal plug shield 48 is provided on the housing and surrounds portions of the housing which extend from an intermediate location to the rearward end 24. The plug shield 48 has a lower shield sidewall 50, the upper shield sidewall 52, and oppositely facing shield endwalls 54 which are against the corresponding housing walls of the plug housing. A latch ear 56 is provided on the upper housing sidewall 28 and is received in an opening in the shield sidewall 52 to retain the shield on the housing. Additionally, a flap 60 is provided on the lower shield sidewall 50 and is formed into one of the openings to further assist in retaining the shield on the housing. The lower shield sidewall has an additional flap 58 which extends over the opening in the lower shield sidewall which is aligned with the strain relief ear 46.

The plug shield is a one-piece stamped and formed member and is reversely bent as shown at 62 to provide an extension 63 which projects into the opening 32. When the prepared cable is inserted into the cable-receiving opening 32 and the strain relief member 48 is moved to its position of FIG. 3, the shielding 9 on the cable is clamped against the extension 63 thereby to provide contact between the cable shielding 9 and the plug shield 48.

The receptacle 4 is constructed generally in accordance with the teachings with the above identified U.S. Pat. Nos. 4,193,654, 4,210,376, and 4,221,458. These patents are hereby incorporated by reference.

Figure 4:
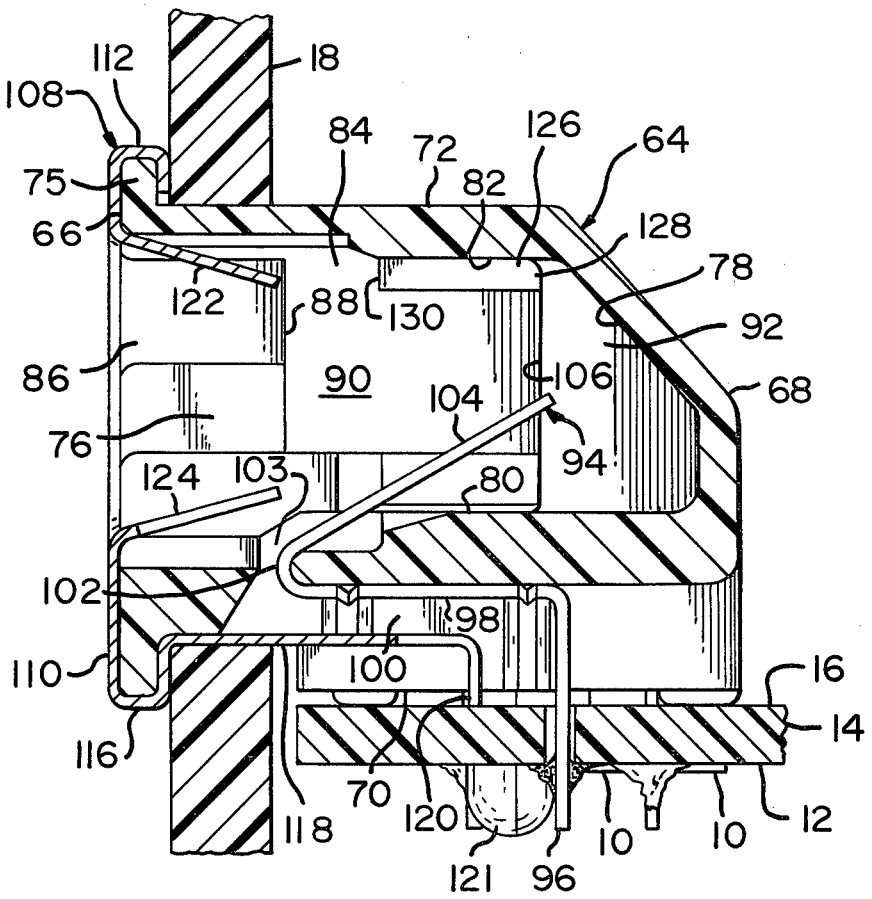
FIG. 4 is a sectional side view of the receptacle.

The receptacle comprises a molded one-piece housing 64 having a mating end 66, a rearward end 68, an upper or first housing sidewall 72, a lower or second housing sidewall 70, and oppositely facing housing endwalls 74. An integral flange 75 is provided adjacent to the mating end and overlaps the opening in the panel 18 as shown in FIG. 4.

A plug-receiving opening 76 extends into the mating end 66 and has an inner end adjacent to the rearward end of the housing as shown at 78. The opening has opposed first and second opening sidewalls 82, 80 and opposed opening endwalls 84. The opening has an entrance portion 86 which is somewhat enlarged relative to the intermediate portion 90 of the opening. The entrance portion receives the forward portion of the plug and partially receives the latch arms 21. The intermediate portion 90 receives portions of the plug adjacent to the mating end thereof and the shoulders 88 on the endwalls coupled with the shoulders 25 on the latch arms 21 of the plug to retain the plug in its mated condition when it is inserted. The rearward portion 92 of the opening 76 has spaced-apart barrier walls which extend to the intermediate portion 90 and have vertical edges 106 as viewed in FIG. 4. These barrier walls define recesses or cells which capture the free ends of the contact portions 104 of the terminals as described below.

Figure 5:
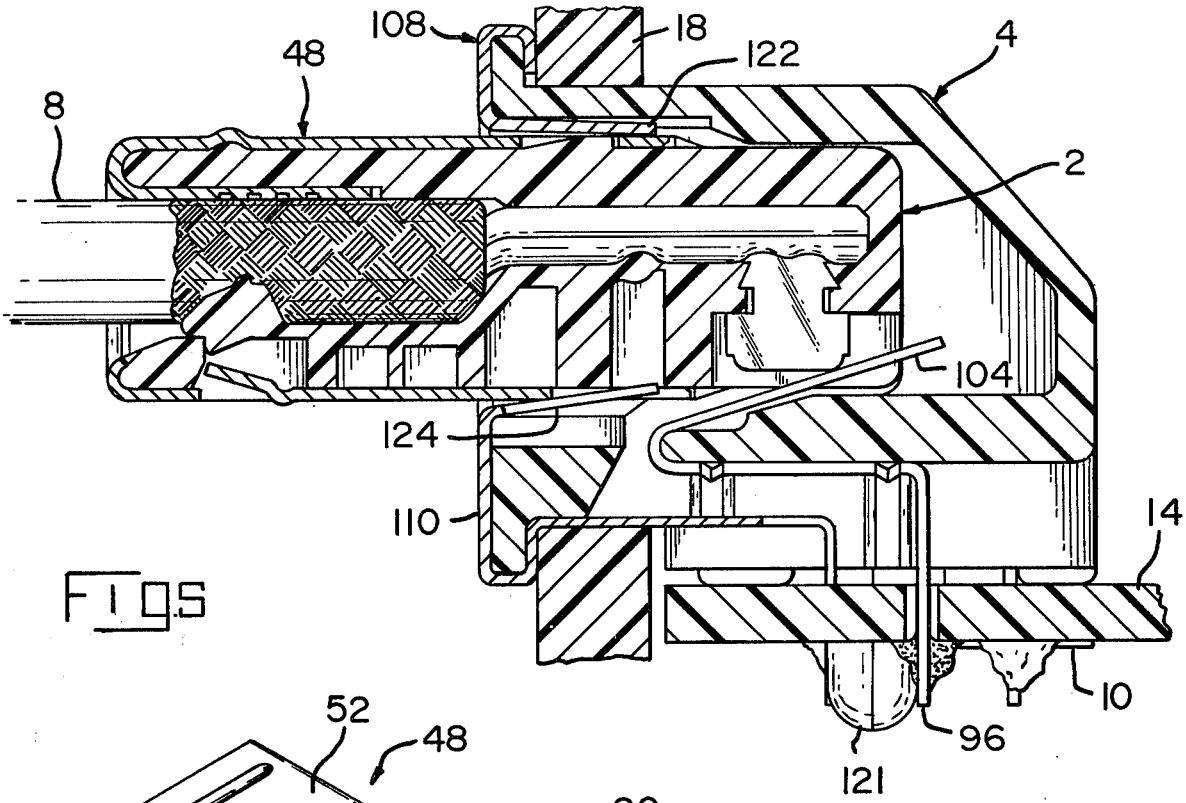
FIG. 5 is a side view showing the plug and receptacle in the mated condition.
Figure 6:
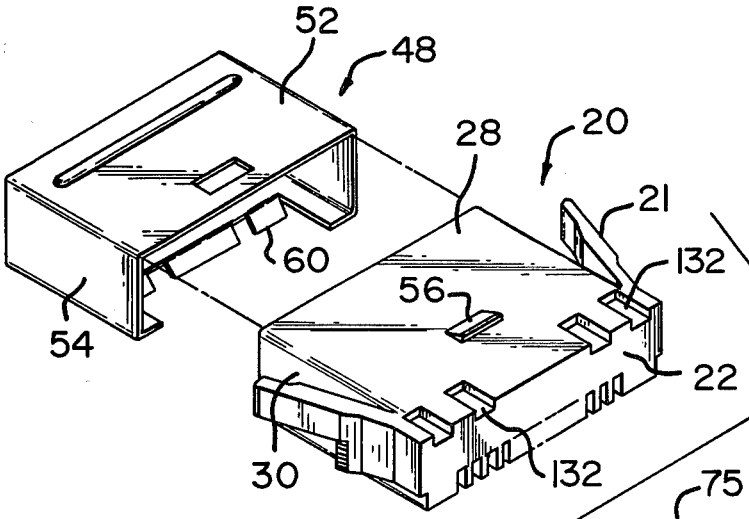
FIG. 6 is a perspective view of the plug with the shield exploded from the plug housing.
Figure 7:
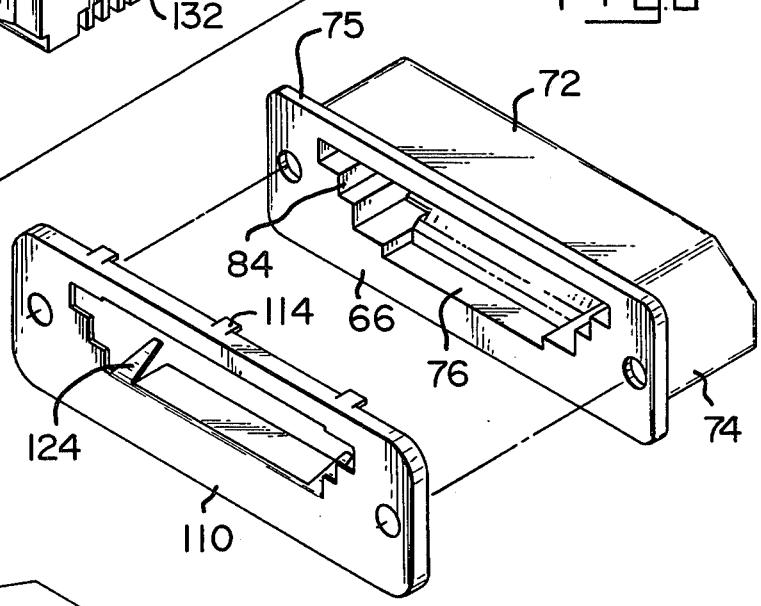
FIG. 7 is a perspective view of the receptacle with the shield exploded from the receptacle housing.

The individual terminals 94 each comprises an elongated strip of sheet metal having a post portion 96 which extends through an opening in the circuit board 14 and is soldered to a conductor on the circuit board, an intermediate portion 98 which is received in a recess 100 in the lower housing side-wall, and a contact spring portion 104 which extends into and through the intermediate portion 90 of the opening 76. Each terminal is reversely bent at 102 to form the cantilever spring contact portion 104 which is engaged by the contact portion 40 of a plug terminal 36 when the plug is inserted in the opening as shown in FIG. 5. The reversely bent portion 102 extends through an opening 103 in the sidewall 80. The terminals 94 are assembled to the housing in the manner described in the above identified U.S. Pat. Nos. 4,221,458 and 4,210,376.

The receptacle shield 108 is a one-piece stamped and formed sheet metal member having a flat mating end section 110 which covers the mating end of the housing and which extends to the edges of the plug-receiving opening 76. Peripheral portions of the shield extend around the flange 75 as shown at 112 and 116 and the portion 116 which extends around the bottom flange as viewed in FIG. 4. has an extension 118 which is parallel to the lower housing sidewall 70 and which extends beneath the recesses 100. One or more ground terminals 120 can be provided on the extension 118 which project through the circuit board and are soldered to a ground conductor on the circuit board as shown at 120.

It is desirable to provide integral mounting members 121 on the housing which serve to hold the housing on the circuit board mechanically and thereby relieve the post 96 of any mechanical loading or stripping.

A plurality of upper and lower shield contacts 122, 124 extend from the mating end section 110 of the shield into the entrance portion 86 of the plug-receiving opening 76. These contact members function as cantilever spring contacts which are engaged by the shielding of the plug when the plug is inserted thereby to provide a conductive path for the shielding material from the cable shielding 9 to the ground conductors on the underside of the circuit board.

Keying of an individual receptacle to a specific plug is achieved by providing one or more keys 126 on the first opening sidewall 84. Each key has an inner end 128 which is adjacent to the edges 106 of the barriers and a leading or outer end 130 which is in the intermediate portion 90 of the opening 76 and which is spaced from the shield contacts 122. Corresponding or complementary keyways 132 are provided in the forward portion of the plug in alignment with the keys so that only connectors and plugs which are keyed to each other can be mated with each other.

Connector assemblies in accordance with the invention have effective shielding on the plug and the receptacle, a contact means which electrically connects the shielding on the plug to the shielding on the receptacle when the parts are mated, and a keying system for the plug and the receptacle. Because of the fact that the keying system comprises keyways in the unshielded forward portion of the plug and recessed keyways in the receptacle, the keying system does not interfere with the effectiveness of the shielding.

We claim:

1. An electrical connector receptacle of the type comprising a molded insulating housing having a mating end, a rearward end, oppositely facing first and second housing sidewalls and oppositely facing housing endwalls extending from the mating end to the rearward end, a plug-receiving opening extending into the mating end, the opening having opposed first and second opening sidewalls, which are proximate to the first and second housing sidewalls, and opposed opening endwalls, a plurality of receptacle terminals in the receptacle, the terminals being arranged in a row which extends between the opening endwalls, each terminal having a cantilever spring contact portion which extends from the second opening sidewall at a location proximate to the mating end, the cantilever spring contact portions extending diagonally into the opening towards the inner end of the opening, the opening being dimensioned to receive a plug having plug terminals therein which contact the cantilever spring contact portions, the receptacle being characterized in that:

at least one key is provided on the first opening sidewall, the key having a leading end and an inner end, the leading end being proximate to, and spaced from, the mating end of the housing, the inner end being remote from the mating end of the housing, a stamped and formed sheet metal receptacle shield is provided on the housing, the receptacle shield extending over and covering, the mating end and extending to the plug-receiving opening, the receptacle shield having cantilever spring shield contact extensions extending into the plug-receiving opening for contacting the plug shield on a complementary plug upon insertion of the plug into the opening, the shield contact extensions being adjacent to the first opening sidewall.

2. An electrical connector as set forth in claim 1 characterized in that the shield extends from the mating end of the receptacle at least partially over the housing towards the rearward end and has an integral ground terminal for connection to an external ground conductor.

3. An electrical connector assembly of the type comprising a plug and a receptacle, the plug and receptacle each comprising an insulating housing having a mating end, a rearward end, oppositely facing housing sidewalls and oppositely facing housing endwalls extending from the mating end to the rearward end, a plug-receiving opening extending into the mating end of the receptacle which receives forward portions of the plug, the opening having opposed first and second opening sidewalls and opposed opening endwalls, a plurality of receptacle terminals in the opening and a plurality of plug terminals in the plug, the receptacle terminals being arranged in a row which extends between the opening endwalls, the plug terminals being proximate to the mating end of the plug and being arranged in a row which extends between the housing endwalls of the plug, the connector being characterized in that:

a plug shield and a receptacle shield are provided on the plug and receptacle respectively, the plug shield overlapping the forward portions of the plug and extending from the forward portions of the plug to the rearward end thereof, the forward portions having an unshielded section which is adjacent to the mating end of the plug, the receptacle shield being on and covering, the mating end of the receptacle and extending to the plug-receiving opening, the plug shield and the receptacle shield having shield contact portions which contact each other when the plug is inserted into the receptacle, the shield contact portions of the receptacle comprising at least one cantilever contact spring which extends obliquely into the plug receiving opening, at least one key and one keyway are provided on the receptacle and plug respectively, the key being on the first opening sidewall and having an inner end which is proximate to the inner end of the plug-receiving opening and a leading end which is proximate to, but inwardly spaced from, the mating end of the receptacle, the keyway being in a first one of the plug housing sidewalls and extending rearwardly from the mating end of the plug, the keyway being in the unshielded section of the plug.

4. An electrical connector assembly as set forth in claim 3 characterized in that the key is integrally molded on the first opening sidewall.

5. An electrical connector assembly as set forth in either of claims 3 or 4 characterized in that each of the receptacle terminals has a spring contact portion which extends from the second opening sidewall at a location proximate to, and spaced from, the mating end of the receptacle, the spring contact portion extending diagonally into the opening and being a cantilever spring.

6. An electrical connector assembly as set forth in claim 5 characterized in that the plug terminals have plug terminal contact portions which are adjacent to the mating end of the plug and to the second plug housing sidewall, the key in the receptacle functioning to prevent partial insertion of a plug which does not have a complementary keyway to the extent that any of the plug terminal contact portions engage any of the spring contact portions in the receptacle.

* * * * *